United States Patent [19]

Raasch

[11] Patent Number: 4,843,812

[45] Date of Patent: Jul. 4, 1989

[54] OPEN-END ROTOR SPINNING DEVICE WITH IMPROVED TWIST CHOKING MEMBER

[75] Inventor: Hans Raasch, Monchen-Gladbach, Fed. Rep. of Germany

[73] Assignee: W. Schlafhorst & Co., Fed. Rep. of Germany

[21] Appl. No.: 219,453

[22] Filed: Jul. 15, 1988

[30] Foreign Application Priority Data

Jul. 16, 1987 [DE] Fed. Rep. of Germany ..... 3723504

[51] Int. Cl.[4] ..... D01H 7/882; D01H 1/135

[52] U.S. Cl. ..... 57/417; 57/334; 57/414

[58] Field of Search ..... 57/414–417, 57/334, 352

[56] References Cited

U.S. PATENT DOCUMENTS

| | | | |
|---|---|---|---|
| 4,258,541 | 3/1981 | Le Chatelier et al. | 57/417 |
| 4,458,477 | 7/1984 | Raasch et al. | 57/417 X |
| 4,499,719 | 2/1985 | Faessler | 57/417 |
| 4,773,211 | 9/1988 | Stahlecker et al. | 57/417 |

FOREIGN PATENT DOCUMENTS

| | | |
|---|---|---|
| 0220546 | 5/1987 | European Pat. Off. . |
| 2130724 | 1/1973 | Fed. Rep. of Germany . |
| 3332498 | 3/1984 | Fed. Rep. of Germany . |
| 8702807 | 7/1987 | Fed. Rep. of Germany . |

*Primary Examiner*—John Petrakes

*Attorney, Agent, or Firm*—Shefte, Pinckney & Sawyer

[57] ABSTRACT

In an open-end rotor spinning device having a rotatable spinning rotor and a coaxial yarn withdrawal navel mounted in a rotor cover, a tubular twist choking member is removably mounted rotatably in general airtight relation to the cover at an angle with respect to the rotor axis with a yarn withdrawal tube affixed coaxially to the twist choking member. A curved passageway extends longitudinally through the twist choking member with plural obliquely-arranged yarn deflection elements constricting the convex side of the passageway. The twist choking member and the yarn withdrawal tube may be selectivey positioned rotatably as a unit to achieve a desired effect on spinning stability and yarn quality.

4 Claims, 1 Drawing Sheet

FIG. 1
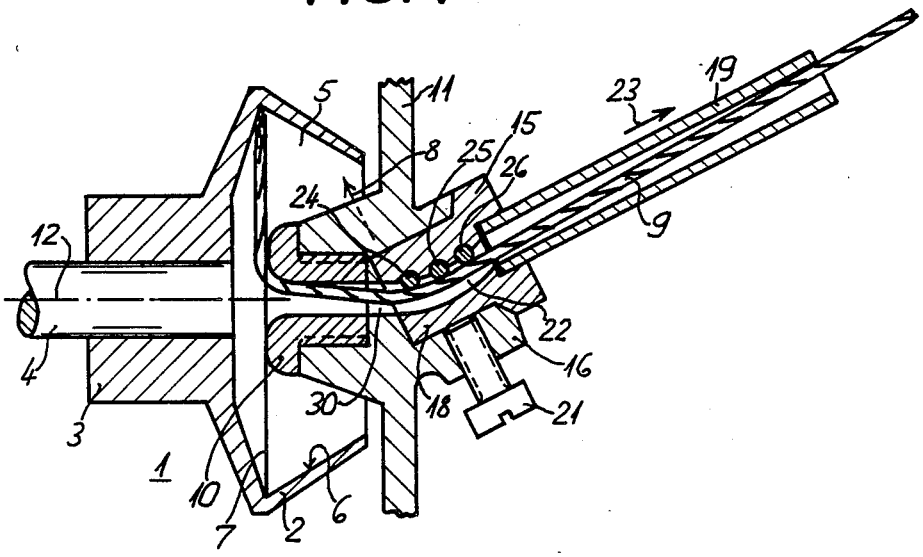
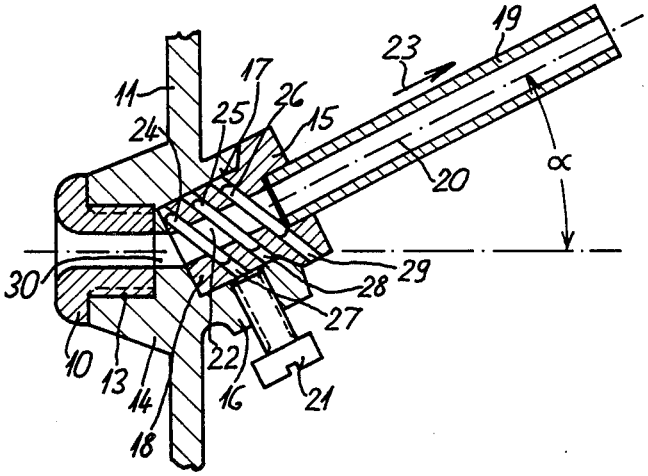
FIG. 2

OPEN-END ROTOR SPINNING DEVICE WITH IMPROVED TWIST CHOKING MEMBER

BACKGROUND OF THE INVENTION

The present invention relates to open-end rotor spinning devices of the basic type having a spinning rotor, a yarn withdrawal navel supported by a rotor coaxially therewith, and a twist choking member for guiding yarn laterally away from the rotor axis into a yarn withdrawal tube following yarn withdrawal through the navel to provide a twist choking action on the traveling yarn.

In open-end rotor spinning devices of the basic above-identified type, it is known to provide yarn engaging elements designed to stop the yarn twisting action produced as the open-end spun yarn is drawn from the spinning rotor, such yarn engaging elements being alternatively referred to as twist choking elements, twist traps or torque stops. Such yarn engaging elements normally provide a noticeable improvement in the spinning stability of the open-end rotor spinning process but disadvantageously the improvement of the spinning stability is accompanied by a reduction of yarn quality, yarn strength and yarn structure and a change in the twist differential and the yarn count or number.

SUMMARY OF THE INVENTION

It is accordingly an object of the present invention to provide an improved twist choking member for an open-end rotor spinning device which both improves the spinning stability and at the same time preserves yarn quality as much as possible. It is a further object of the present invention to provide such a twist choking member which does not impair the ability of the open-end rotor spinning device to draw a yarn end into the spinning rotor by suction through the yarn withdrawal guiding arrangement during an automatic spinning restart following a stoppage of the spinning device.

The present invention achieves such objectives in an open-end rotor spinning device of the basic type having a spinning rotor and a rotor cover supporting a coaxial yarn withdrawal navel by providing a twist choking member mounted to the cover in generally airtight relation thereto at an angle with respect to the rotational axis of the rotor and defining a curved yarn passageway longitudinally through the twist choking member for guiding yarn laterally away from the rotor axis following withdrawal through the navel. The curved yarn passageway presents opposed convex and concave sides with the twist choking member having a plurality of yarn deflection elements arranged within the passageway at its convex side obliquely with respect to the longitudinal extent of the passageway. The deflection elements constrict the cross-sectional area of the passageway to provide a twist choking action on yarn traveling therethrough. The twist choking member is selectively removable from the cover to permit replacement and is further selectively rotatable about its longitudinal extent with respect to the cover for selective rotational positioning of the twist choking member. The cover includes suitable means for selectively retaining the twist choking member in a desired rotational disposition. A yarn withdrawal tube is affixed to the twist choking member in communication with its curved yarn passageway for transporting yarn following travel through the passageway. The rotatability of the twist choking member about its longitudinal extent enables the rotational disposition of the twist choking member to be experimentally changed so as to locate the disposition of the twist choking member providing the most advantageous level of spinning stability and yarn quality or yarn structure. Once the optimal disposition is determined, the twist choking member may be fixed to remain in such disposition for the duration of a given spinning operation.

Preferably, the cover is configured to define a mounting recess for insertion therein of the twist choking member, with the twist choking member having a longitudinal rotational axis about which the exterior periphery of the member is symmetrical. In a preferred embodiment, the mounting recess of the cover is cylindrical with the twist choking member having a cylindrical mounting neck for fitted rotatable insertion in the cylindrical mounting recess. This construction will thereby be understood to permit the rotational disposition of the twist choking member to be essentially infinitely changeable in contrast to an alternative construction wherein the twist choking member may have a mounting neck of a polygonal cross-sectional symmetry which would facilitate only incremental stepwise changes in the rotational disposition of the twist choking member within a mounting recess in the rotor cover of a compatible polygonal cross-section.

Since the present invention provides for insertion of the twist choking member into the mounting recess of the cover in an essentially airtight manner, air leakage between the inserted twist choking member and the cover does not occur so as to avoid any undesired effect on the spinning operation which such air flow may cause. A hermetic seal between the twist choking member and the cover is accordingly not necessary.

The yarn withdrawal tube in the present invention may be constructed as a substantially linear tube and may be permanently affixed to the twist choking member coaxial with its rotational axis. This construction provides the advantage that the yarn withdrawal tube will have the same relative disposition with respect to the other components of the rotor spinning device regardless of changes in the rotational disposition of the twist choking member. Accordingly, a conventional device for automatic spinning restart of the rotor spinning device following a stoppage thereof is enabled to locate the yarn withdrawal tube at any given spinning station without regard to the rotational positioning of the twist choking member.

BRIEF DESCRIPTION OF THE DRAWINGS

FIG. 1 is a sectional view taken axially through an open-end rotor spinning device having a twist choking member according to the present invention; and FIG. 2 is another axial cross-sectional view of a portion of the open-end rotor spinning device of FIG. 1 showing the twist choking member in a different rotational disposition.

DESCRIPTION OF THE PREFERRED EMBODIMENT

Referring now to the accompanying drawings and initially to FIG. 1, an open-end rotor spinning device, broadly indicated at 1, is shown in axial cross-section, the device including a spinning rotor 2 having a neck portion 3 to which a coaxial drive shaft 4 is mounted for rotational driving of the rotor 2. The rotor 2 has a radially inwardly tapering annular side wall 6 defining an interior spinning chamber 5 within the rotor 2 which is open at the axial end of the rotor 2 opposite its drive shaft 4. An annular fiber collection groove 7 is formed within the interior of the rotor 2 at the base of the annular wall 6. The open side of the rotor 2 is essentially closed by a cover 11 supporting a yarn withdrawal navel 10 which defines a central yarn withdrawal opening coaxial with the axis of rotation 12 of the rotor 2 as defined by its drive shaft 4. Specifically, the cover 11 has a central opening 30 formed coaxial with the axis of rotation 12 of the rotor 2 with an annular wall portion 14 of the cover 11 extending coaxially about the opening 30 into the spinning chamber 5, the wall 14 interiorly defining a threaded bore communicating with the opening 30 in which bore a threaded neck portion 13 of the navel 10 is fitted.

In basic operation, staple-length fibers are fed in the direction of the arrow 8 into the spinning chamber 5 onto the annular side wall 6 and the fibers slide along the annular wall 6 into the annular collection groove 7. The collected fibers are continuously drawn outwardly of the spinning rotor 2 at its axis through the coaxial central opening in the navel 10 by a pair of rollers (not shown), the withdrawn yarn then being wound onto a bobbin or spool (also not shown).

According to the present invention, the cover 11 is formed at its side opposite the rotor 2 with an annular projecting wall 16 which defines a recess or bore 17 which communicates with the central opening 30 in the cover 11, the bore 17 being of a uniform cross-sectional shape, preferably cylindrical, which is symmetrical about a longitudinal bore axis oriented at an angle a of approximately thirty degrees (30°) to the common axis 12 of the rotor 2, the navel 10 and the central opening 30 of the cover 11. A tubular twist choking member 15 is inserted by a neck portion 18 thereof into the bore 17, the exterior periphery of the neck portion 18 being of a uniform cross-sectional shape, preferably cylindrical, which is symmetrical about a longitudinal axis of the twist choking member 15 in correspondence to the symmetrical shape of the bore 17 to provide a generally airtight but removable fit therein while the symmetrical configuration of the bore 17 and the neck portion 18 of the twist choking element 15 permit selective rotational repositioning of the twist choking element 15 about its longitudinal axis within the bore 17. A set screw 21 is threaded radially through the annular wall 16 of the cover 11 for selective movement into and out of clamping engagement with the twist choking member 15 to permit the member 15 to be selectively rotated and fixed in any desired rotational disposition with respect to the wall 16.

A curved passageway 22 extends longitudinally through the twist choking member 15 to communicate with the cover opening 30 at the longitudinal end of the twist choking member 15 inserted into the bore 17 and to open outwardly away from the cover 11 at the opposite longitudinal end of the twist choking member 15. A linear yarn withdrawal tube 19 is permanently affixed to the outward longitudinal end of the twist choking member 15 in communication with its curved passageway 22 with the longitudinal axis 20 of the tube 19 coaxial with the rotational axis of the twist choking member 15.

As seen in FIG. 1, the curved passageway 22 of the twist choking member 15 presents opposed concave and convex sides with respect to the longitudinal center-line of the passageway 22 and the twist choking member 15 includes a plurality of yarn deflection elements 24, 25, 26 disposed within the curved passageway 22 at its convex side with the deflection elements extending obliquely with respect to the direction of yarn travel through the twist choking member 15, as seen in Fig.2. In the illustrated embodiment, the yarn deflection elements 24, 25, 26 comprise pins which are inserted in bores 27, 28, 29 formed in the twist choking member 15 approximately tangentially with respect to the curved passageway 22. In this manner, the yarn deflection elements 24, 25, 26 serve to constrict the cross-sectional area of the curved passageway 22 along one side thereof, namely its convexly curved side.

As aforementioned, in the basic operation of the described open-end rotor spinning device, fibers are supplied continuously into the rotating spinning rotor 2 and a spun yarn 9 is continuously withdrawn axially therefrom by a pair of rollers and subsequently wound onto a bobbin or spool. During withdrawal, the yarn 9 travels initially through the yarn withdrawal navel 10 by which the yarn is deflected approximately ninety degrees (90°) from its generally radial path of travel from the fiber collection groove 7 of the rotor 2. The yarn 9 then travels through the coaxial opening 30 in the cover 11 and therefrom into and through the curved yarn passageway 22 of the twist choking member 15 wherein the yarn is further deflected laterally away from the axis of the spinning rotor 2 and the yarn engages the deflection elements 24, 25, 26 which produce a twist choking action on the yarn. The yarn 9 then travels through the linear yarn withdrawal tube 19 and is subsequently wound onto a spool or bobbin.

Advantageously, the present invention thus enables the twist choking member 15 and the yarn withdrawal tube 19 to be mounted as a unit rotationally on the cover 11, the set screw 21 enabling the rotational disposition of the unit to be selectively changed and fixed as desired. For example, FIG. 2 illustrates the twist choking member 15 and the yarn withdrawal tube 19 rotated approximately ninety degrees (90°) from their disposition shown in FIG. 1. In this manner, the twist choking effect of the yarn deflection elements 24, 25, 26 of the twist choking member 15 may be selectively adjusted experimentally by rotation of the twist choking member 15 to achieve an optimal disposition of the member 15 which provides the best compromise of spinning stability and yarn quality characteristics for any given spinning operation, without changing the angular disposition of the yarn withdrawal tube 19 with respect to the other structural components of the open-end rotor spinning device.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1.An open-end rotor spinning device comprising a spinning rotor rotatable about an axis, said rotor defining an interior spinning area open at one axial side of said rotor, a cover disposed in covering relation to said open side of said rotor, a yarn withdrawal navel mounted on said cover and defining a yarn withdrawal opening essentially coaxially with said spinning rotor for withdrawal of yarn generally axially from said interior spinning area of said rotor, a twist choking member mounted to said cover in generally airtight relation thereto at an angle with respect to the rotational axis of said spinning rotor and defining a curved yarn passageway longitudinally therethrough for guiding yarn laterally away from said rotational axis of said rotor following withdrawal through said navel, said curved yarn passgeway presenting opposed convex and concave sides, said twist choking member having a plurality of yarn deflection elements arranged within said curved yarn passageway at its convex side obliquely with respect to the longitudinal extent of said passageway for constricting its cross-sectional area to provide a twist choking action on yarn traveling therethrough, said twist choking member being selectively removable from said cover to permit replacement and being selectively rotatable about its longitudinal extent with respect to said cover for selective rotational positioning of said twist choking member, said cover including means for selectively retaining said twist choking member in a desired rotational disposition, and a yarn withdrawal tube affixed to said twist choking member in communication with said curved yarn passageway for transporting yarn following travel through said passageway, said cover, said twist choking member and said yarn withdrawal tube being arranged cooperatively with one another such that selective rotational positioning of said twist choking member is operative for changing its relative rotational orientation with respect to said cover while maintaining said yarn withdrawal tube at a predetermined orientation with respect to said cover, thereby to alter the twist choking action of said twist choking member.

2. An open-end rotor spinning device according to claim 1 and characterized further in that said cover defines a mounting recess for insertion of said twist choking member, and said twist choking member has a longitudinal rotational axis with the exterior periphery of said twist choking member being symmetrical about its said axis.

3. An open-end rotor spinning device according to claim 2 and characterized further in that said mounting recess of said cover is cylindrical and said twist choking member comprises a cylindrical mounting neck for fitted rotatable insertion in said mounting recess.

4. An open-end rotor spinning device according to claim 1 and characterized further in that said yarn withdrawal tube is generally linear and is permanently affixed to said twist choking member coaxial with its rotational axis.

* * * * *